US011215152B2

(12) United States Patent
Billot et al.

(10) Patent No.: US 11,215,152 B2
(45) Date of Patent: Jan. 4, 2022

(54) FUEL PUMP ADAPTER

(71) Applicant: Walbro LLC, Tucson, AZ (US)

(72) Inventors: Darin R. Billot, Snover, MI (US); Elton J. Fisch, Caro, MI (US)

(73) Assignee: Walbro LLC, Cass City, MI (US)

( * ) Notice: Subject to any disclaimer, the term of this patent is extended or adjusted under 35 U.S.C. 154(b) by 111 days.

(21) Appl. No.: 16/614,969

(22) PCT Filed: May 22, 2018

(86) PCT No.: PCT/US2018/033838
§ 371 (c)(1),
(2) Date: Nov. 19, 2019

(87) PCT Pub. No.: WO2018/217712
PCT Pub. Date: Nov. 29, 2018

(65) Prior Publication Data

US 2021/0164427 A1 Jun. 3, 2021

Related U.S. Application Data

(60) Provisional application No. 62/509,224, filed on May 22, 2017.

(51) Int. Cl.
*F02M 37/10* (2006.01)

(52) U.S. Cl.
CPC ..... *F02M 37/103* (2013.01); *F02M 2200/03* (2013.01); *F02M 2200/09* (2013.01); *F02M 2200/26* (2013.01); *F02M 2200/852* (2013.01); *F02M 2200/853* (2013.01)

(58) Field of Classification Search
CPC ..... F02M 37/103; F02M 2200/852; F02M 2200/03; F02M 2200/853; F02M 2200/26; F02M 2200/09
See application file for complete search history.

(56) References Cited

U.S. PATENT DOCUMENTS

| | | | | |
|---|---|---|---|---|
| 7,056,102 | B2 | 6/2006 | Cremer et al. | |
| 8,939,736 | B2 | 1/2015 | Israelson et al. | |
| 2008/0216801 | A1* | 9/2008 | Kanamaru | F02M 37/106 123/509 |
| 2013/0133765 | A1* | 5/2013 | Israelson | F01C 21/10 137/565.13 |

FOREIGN PATENT DOCUMENTS

| | | | |
|---|---|---|---|
| JP | 2007291866 | A | 11/2007 |
| JP | 2013142358 | A | 7/2013 |

OTHER PUBLICATIONS

Written Opinion & International Search Report for PCT/US2018/033838 dated Sep. 14, 2018, 14 pages.

* cited by examiner

*Primary Examiner* — Jacob M Amick
*Assistant Examiner* — Charles J Brauch
(74) *Attorney, Agent, or Firm* — Reising Ethington P.C.; Matthew J. Schmidt

(57) ABSTRACT

In at least some implementations, an adapter, for a fuel pump having a casing, has a base having an axis and an opening through which fluid may flow, and multiple tabs connected to the base. The tabs are circumferentially spaced apart with a void between at least part of the tabs, and at least two tabs have a contact portion that extends radially inwardly to define a minimum diameter opening between the tabs. Each contact portion extends along a portion less than all of the surface areas of the radially inner surface of the tabs.

19 Claims, 7 Drawing Sheets

FUEL PUMP ADAPTER

REFERENCE TO RELATED APPLICATIONS

This application claims the benefit of U.S. Provisional Application Ser. No. 62/509,224 filed on May 22, 2017, the entire contents of which are incorporated herein by reference in their entireties.

TECHNICAL FIELD

The present disclosure relates generally to an adapter for a fuel pump.

BACKGROUND

Fuel systems for combustion engines can sometimes include a fuel pump assembly that pumps fuel from a fuel tank to an engine. The fuel pump generally is carried by some structure either within or outside of the fuel tank. Fuel is taken into the fuel pump through an inlet, the pressure of the fuel is increased, and the fuel is discharged from the fuel pump and delivered to the engine. Among other things, the size of various components of the fuel pump and a container or bracket in or on which the fuel pump is received may vary across a production run of these components. The coupling between such components may be looser or tighter as a result and vibrations may occur which may be audible and/or may affect the integrity of the coupling or the longevity of certain components.

SUMMARY

In at least some implementations, an adapter, for a fuel pump having a casing, has a base having an axis and an opening through which fluid may flow, and multiple tabs connected to the base. The tabs are circumferentially spaced apart with a void between at least part of the tabs, and at least two tabs have a contact portion that extends radially inwardly to define a minimum diameter opening between the tabs. Each contact portion extends along a portion less than all of the surface areas of the radially inner surface of the tabs.

In at least some implementations, a radially outer surface at least a portion of which defines a maximum radial dimension of the adapter when the tabs are in an unflexed or at rest position. In at least some implementations, a flexible ring is carried by the adapter and extends radially outwardly from at least a portion of the adapter. The adapter may define a fuel pump receiving area between an inner surface of the base and the inner surface of the tabs, and the ring may be separate from the fuel pump receiving area.

In at least some implementations, the contact portions extend between 5% and 90% of the circumference of a circle bounded by the contact portions. Each contact portion may have an inner surface arranged to engage a fuel pump received between the tabs and the inner surface may have a surface area of less than 400 $mm^2$.

In at least some implementations, each of the at least two tabs with a contact portion has a first portion connected to the base and a second portion that extends from the first portion to an end of the tab, the at least two tabs having a portion that extends radially outwardly to define a maximum outer dimension of the adapter and a portion that extends radially inwardly to the contact portions. The at least two tabs may be flexible and resilient and may be radially inwardly flexed.

In at least some implementations, a fuel pump assembly includes a fuel pump having a casing with an inlet through which fuel enters the casing, and a pumping element received within the casing, and an adapter received around at least part of the casing. The adapter has a base that is received adjacent to the inlet, an axis, an opening in communication with the inlet, and multiple tabs connected to the base. The tabs are circumferentially spaced apart with a void between at least part of two adjacent ones of the tabs, and wherein at least two tabs have an inner surface with a contact portion engaged with the casing and a portion that is spaced radially outwardly from the casing.

In at least some implementations, the contact portions extend between 5% and 90% of the circumference of a circle bounded by the contact portions. In at least some implementations, each contact portion has an inner surface arranged to engage a fuel pump received between the tabs and the inner surface has a surface area of less than 400 $mm^2$.

In at least some implementations, each of the at least two tabs has a first portion connected to the base and a second portion that extends from the first portion to an end of the tab, the at least two tabs may have a portion that extends radially outwardly to define a maximum outer dimension of the adapter and a portion that extends radially inwardly to the contact portions. In at least some implementations, the at least two tabs are flexible and resilient and may be radially inwardly flexed. In at least some implementations, a container is provided that has a cavity in which the fuel pump and the adapter are at least partially received, and wherein the cavity having an inner dimension that is less than the maximum outer dimension of the adapter, and wherein at least some of the tabs are flexed inwardly when the adapter is received in the cavity.

In at least some implementations, a container is provided that has a cavity in which the fuel pump is at least partially received, the cavity is defined at least in part by an inner surface of the container, and wherein an outer surface of at least two tabs engages the container inner surface. The area of engagement between the outer surface of the tabs and the container inner surface may be axially spaced from the contact portions of the tabs. And the at least two tabs may extend axially from the base and each of the at least two tabs may engage the container along less than all of the axial length of the outer surface, and each of the at least two tabs may engage the casing along less than all of the axial length of the inner surface.

In at least some implementations, a container is provided that has a cavity in which the fuel pump is at least partially received, the cavity defined at least in part by an inner surface of the container, and a flexible ring is carried by the adapter and extends radially outwardly from at least a portion of the adapter and is engaged with the container inner surface. In at least some implementations, at least some of the tabs do not engage the container inner surface. In at least some implementations, the contact portions are defined by protrusions that extend inwardly from the tabs having the contact portions.

The various features set forth in the summary may be used in various combinations such that certain embodiments include all or less than all of the complementary or not mutually exclusive features set forth above and described further below.

BRIEF DESCRIPTION OF THE DRAWINGS

The following detailed description of certain embodiments and best mode will be set forth with reference to the accompanying drawings, in which.

DETAILED DESCRIPTION

Figure 1:
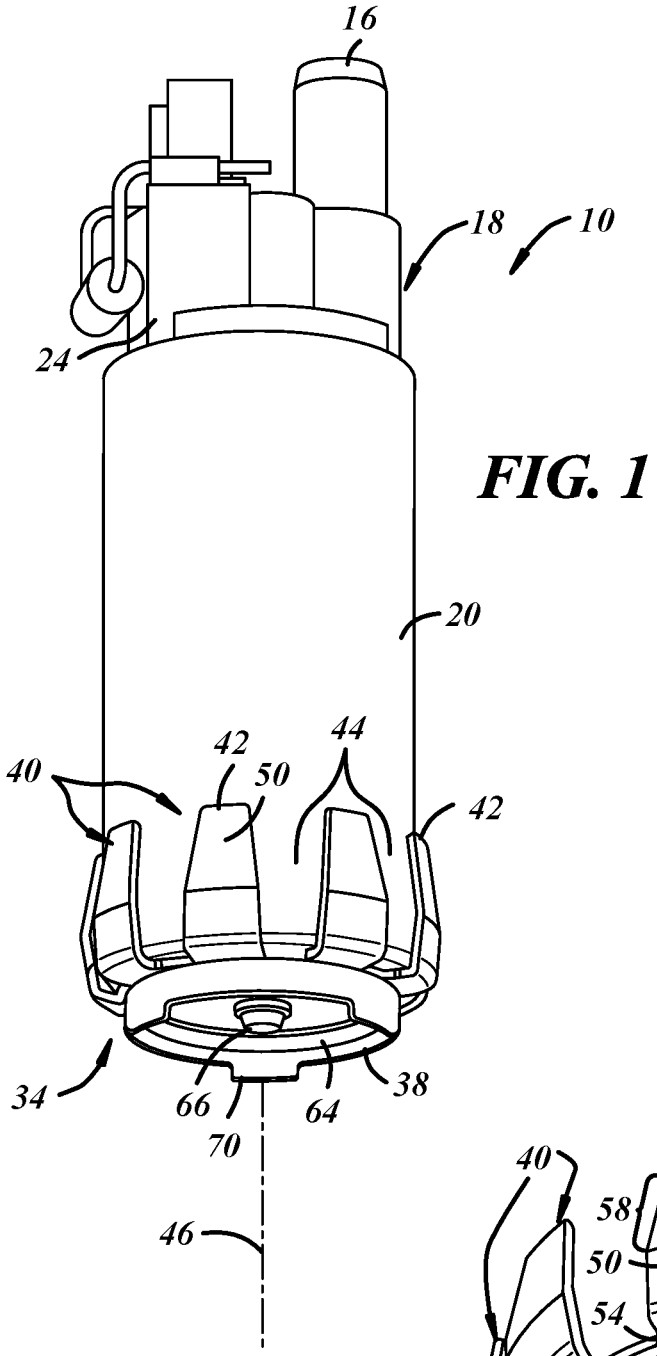
FIG. 1 is a perspective view of a fuel pump including an adapter at an inlet end of the fuel pump.
Figure 2:
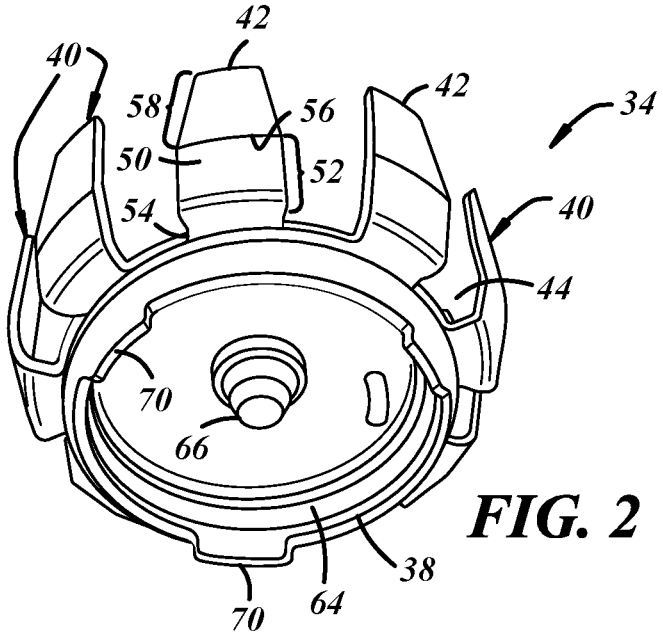
FIG. 2 is a perspective bottom view of the adapter.
Figure 3:
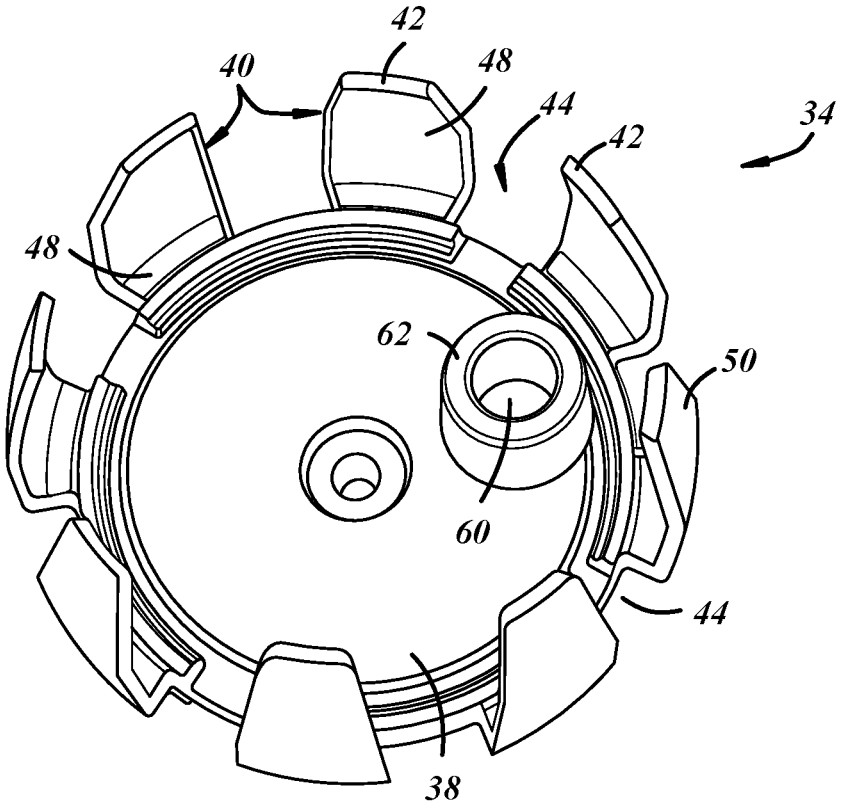
FIG. 3 is a perspective top view of the adapter.
Figure 4:
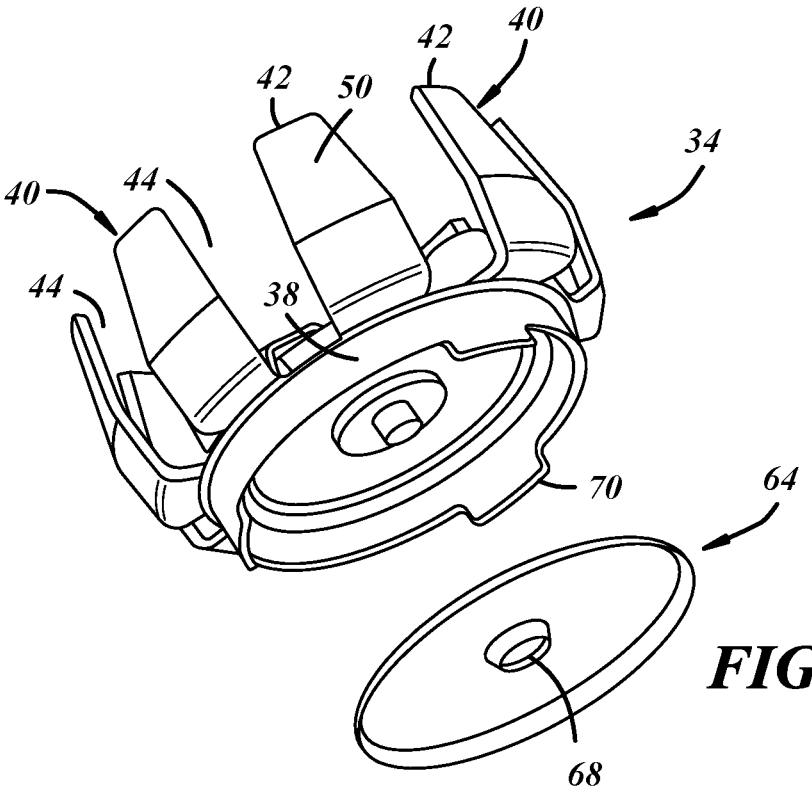
FIG. 4 is a perspective exploded view of the adapter and a filter or screen that may be coupled to the adapter.

Referring in more detail to the drawings, FIG. 1 illustrates a fuel pump 10 that may be used to pump fuel from a container 12 (FIG. 5) to an engine to support engine operation. The container 12 may be part of a fuel supply module that is located within a fuel tank of a fuel system. The container 12 may also be, by way of non-limiting examples, a fuel-vapor separator or the fuel tank itself. A supply of fuel is provided within the container 12 and an inlet 14 (FIG. 5) of the fuel pump 10 is within the fuel so that the fuel pump 10 can draw fuel into the inlet 14, increase the pressure of the fuel and discharge pressurized fuel from an outlet 16 of the fuel pump. The fuel pump 10 may include an electric motor that drives a pumping element such as gears in a gerotor type pump or an impeller in a turbine type pump. The motor and pumping element may be received within a pump housing 18 which, in at least some implementations, may include a generally cylindrical casing 20, an inlet body 22 (FIG. 5) in which the pump inlet 14 is defined and an outlet body 24 in which the pump outlet 16 is defined with the inlet and outlet bodies 22, 24 surrounded partially by and carried by and sealed to the casing 20. Such a fuel pump 10 is disclosed in more detail in U.S. Pat. No. 8,939,736, the disclosure of which is incorporated herein by reference in its entirety.

Figure 5:
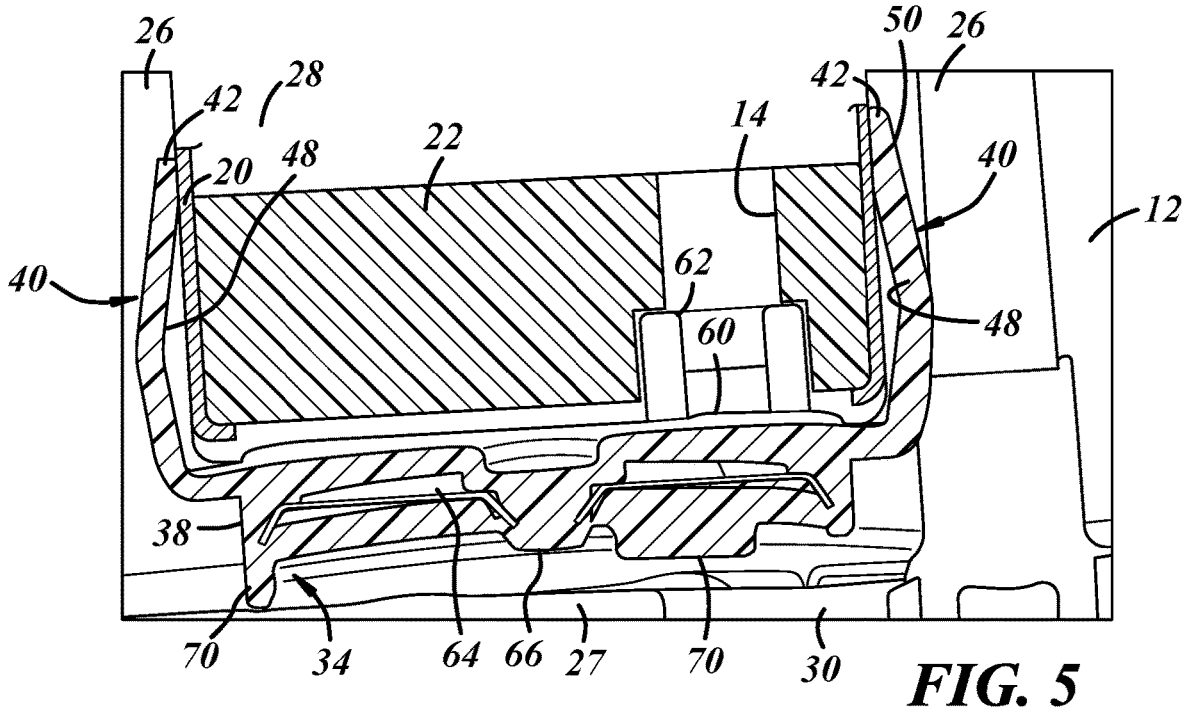
FIG. 5 is a fragmentary sectional view of a portion of a fuel pump container wall showing the adapter within a cavity of the container in a position the adapter would be in assembly of a fuel pump within the cavity.
Figure 6:
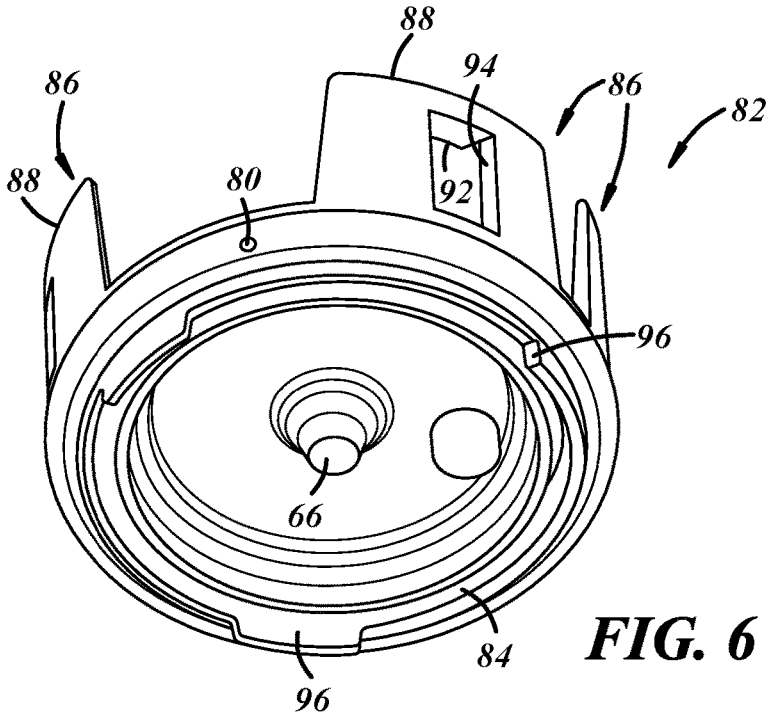
FIG. 6 is a perspective bottom view of an adapter with an exterior ring.
Figure 7:
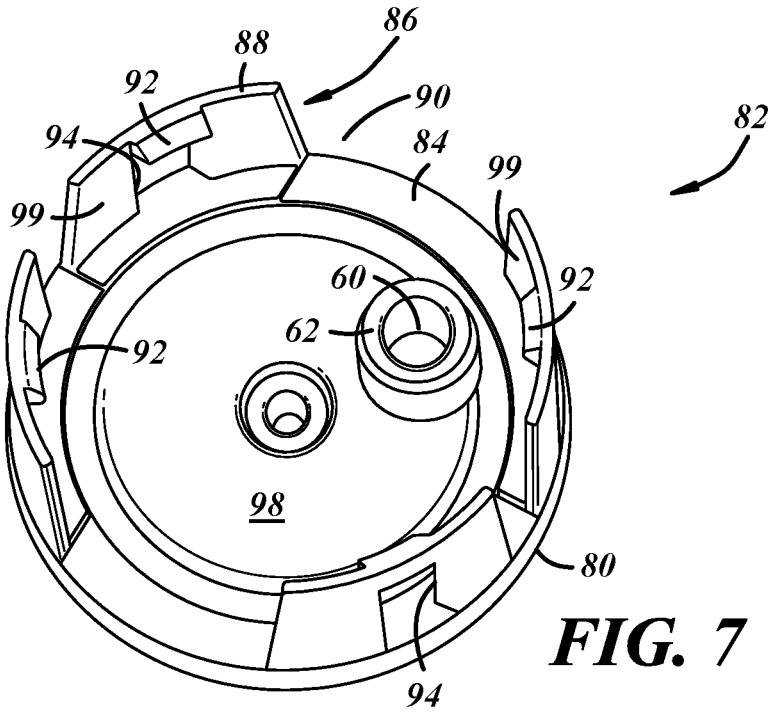
FIG. 7 is a perspective top view of the adapter of FIG. 6.
Figure 8:
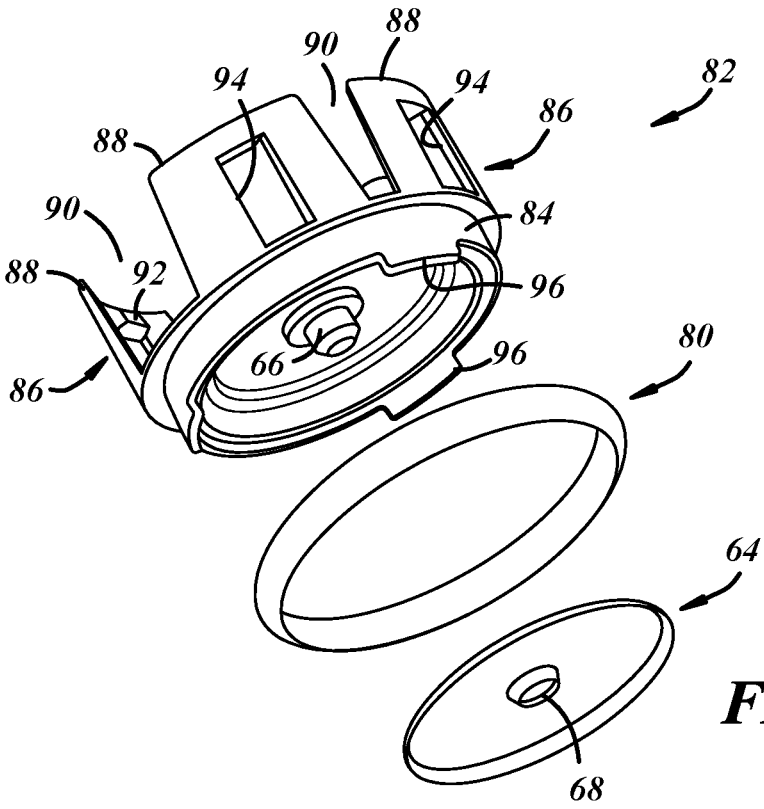
FIG. 8 is a perspective exploded view of the adapter and a filter or screen that may be coupled to the adapter.
Figure 9:
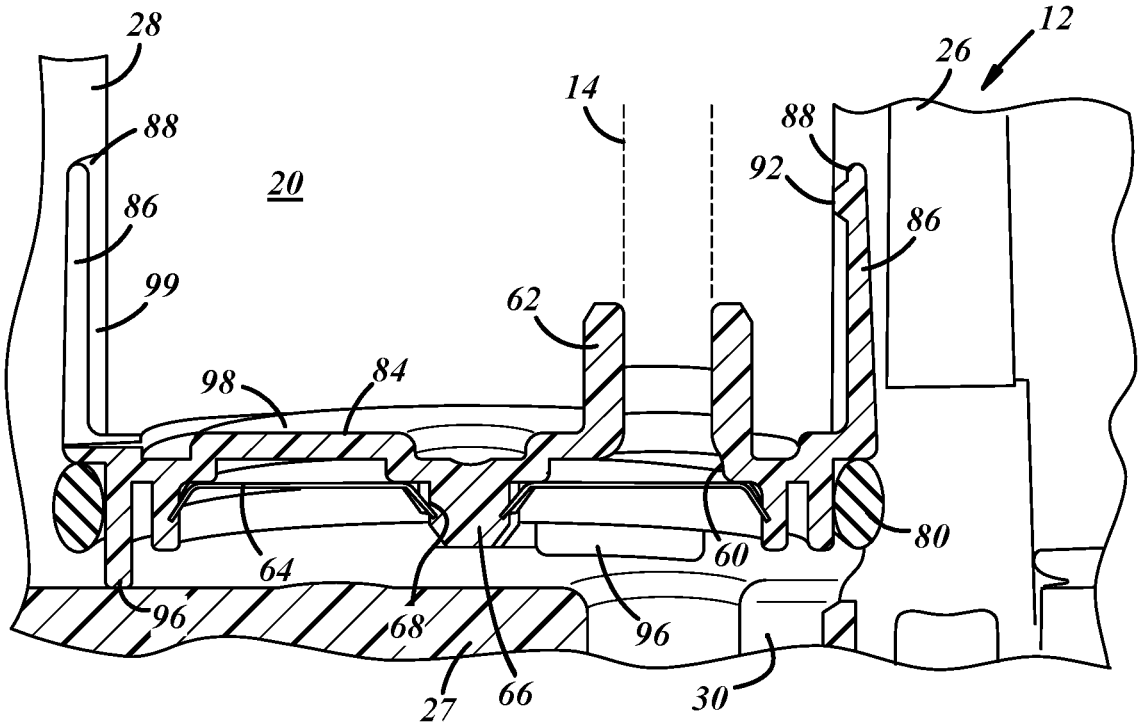
FIG. 9 is a fragmentary sectional view of a portion of a fuel pump container wall showing the adapter within a cavity of the container in a position the adapter would be in assembly of a fuel pump within the cavity.
Figure 10:
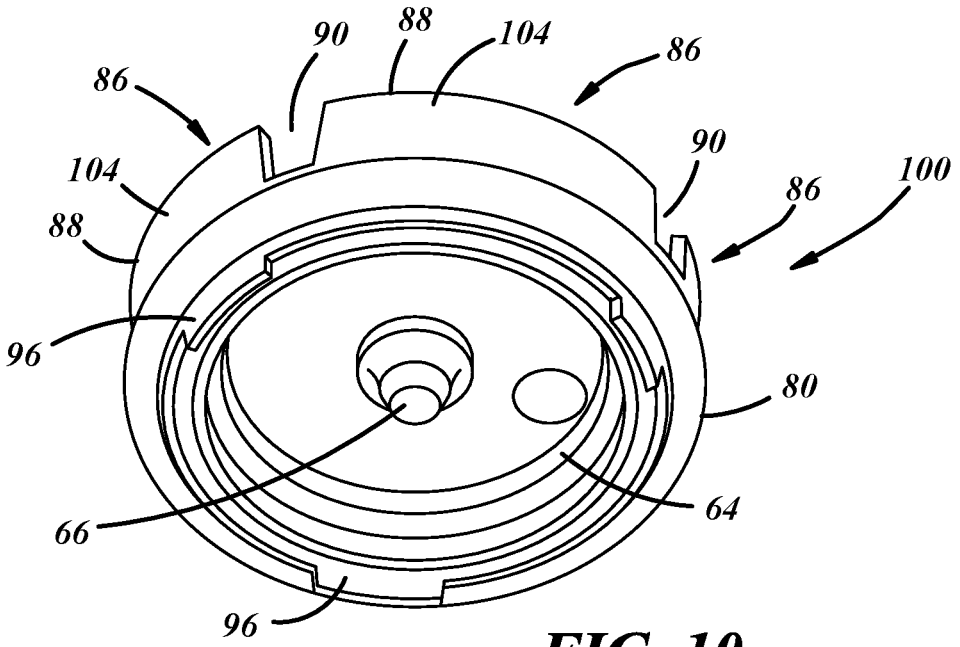
FIG. 10 is a perspective bottom view of an adapter with an exterior ring.
Figure 11:
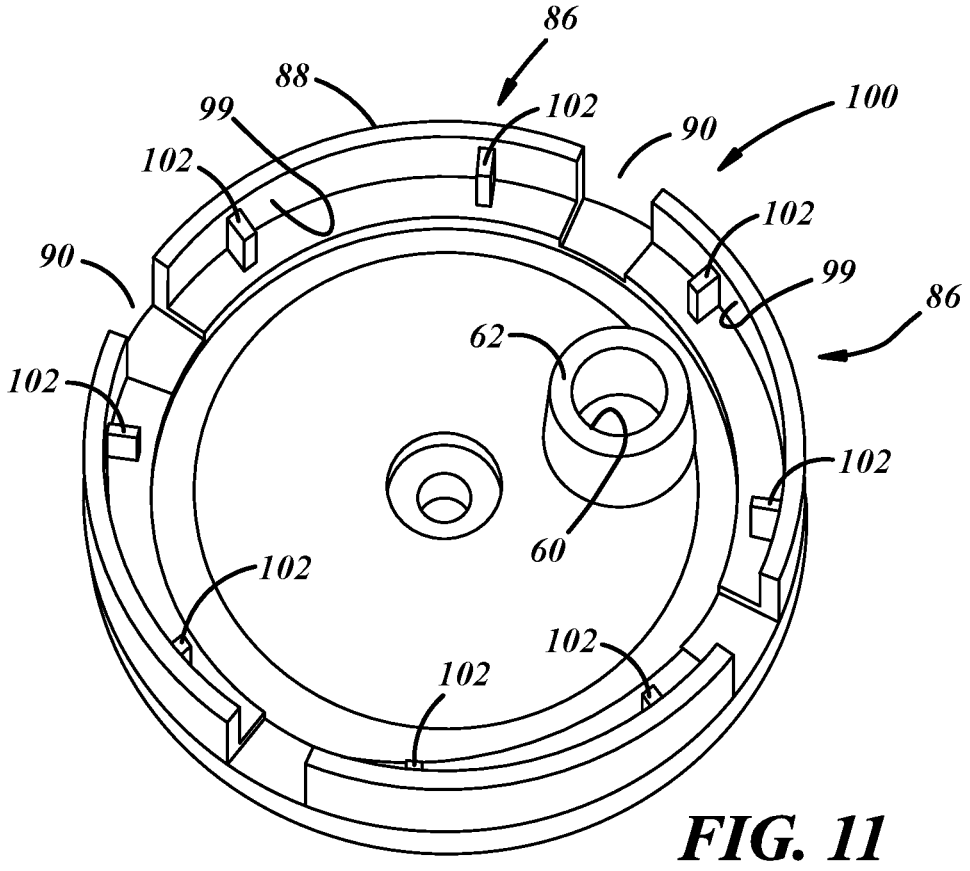
FIG. 11 is a perspective top view of the adapter of FIG. 10.
Figure 12:
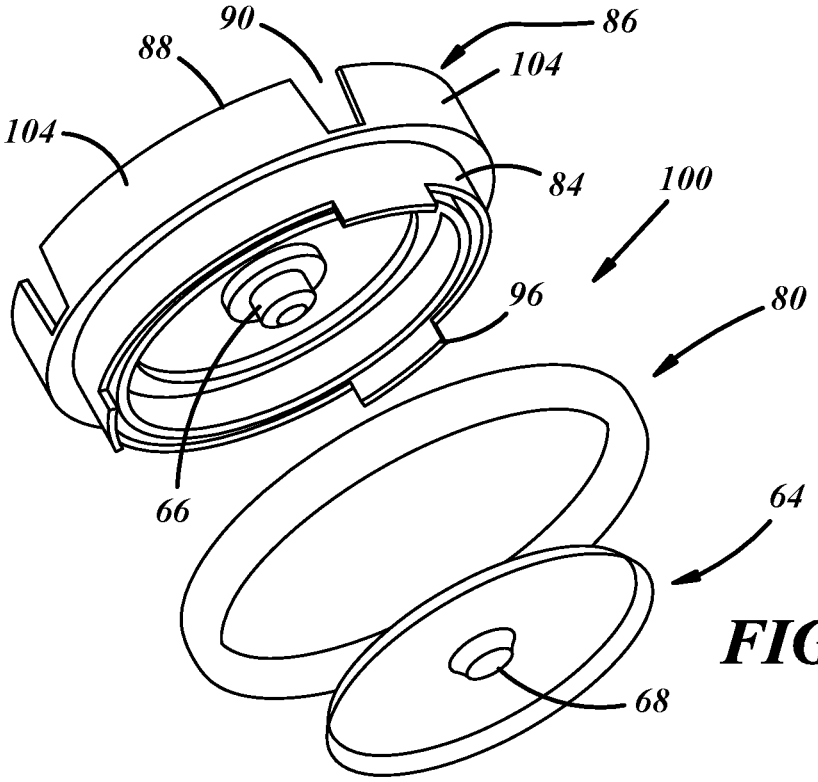
FIG. 12 is a perspective exploded view of the adapter and a filter or screen that may be coupled to the adapter.
Figure 13:
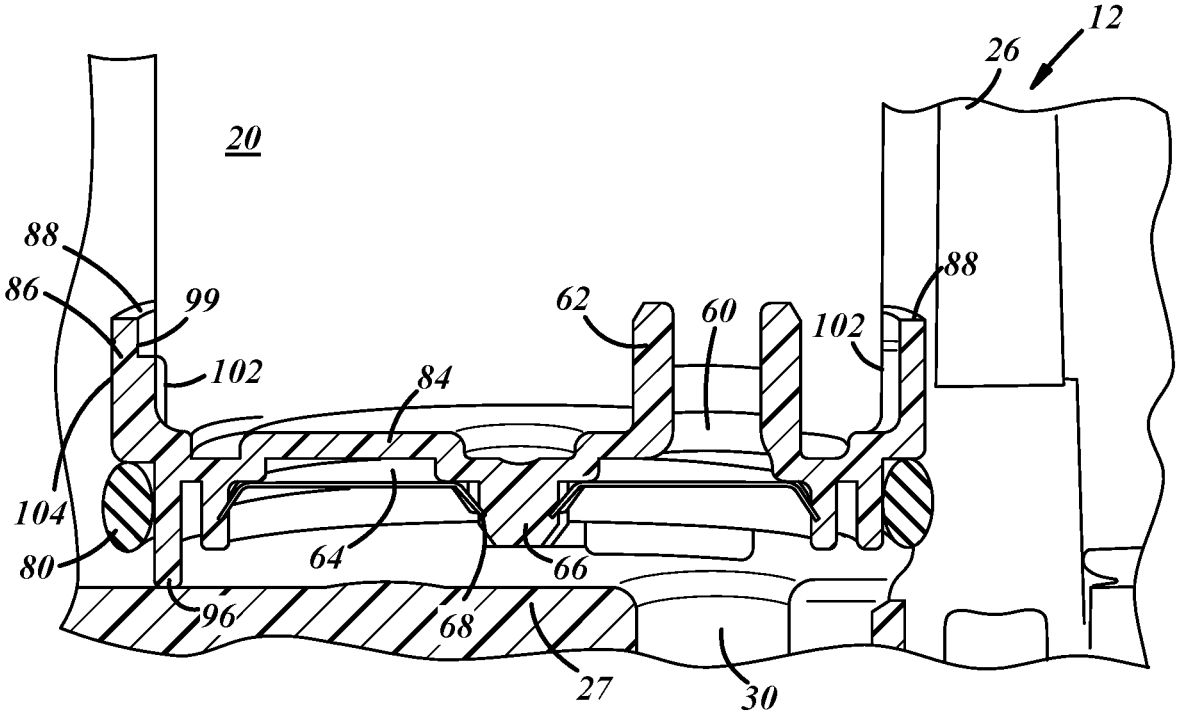
FIG. 13 is a fragmentary sectional view of a portion of a fuel pump container wall showing the adapter within a cavity of the container in a position the adapter would be in assembly of a fuel pump within the cavity.

As shown in FIG. 5, the container 12 may include one or more walls including one or more sidewalls 26 and an end wall 27 that define a cavity 28 in which the fuel pump 10 is arranged in assembly. The container 12 may include a port or passage 30 leading from outside of the container to the cavity 28 to permit fuel to flow into the container from the fuel tank or other fuel supply. In the implementation shown, the port 30 extends through the end wall 27 and the end wall 27 is arranged at or near the bottom of the container 12 so that the port 30 is within fuel in the fuel tank even when there is a relatively low fuel level in the tank. The cavity 28 may include a cylindrical portion that has a diameter larger than the diameter of the fuel pump casing 20 and larger than the inlet end of the fuel pump 10. In assembly, as will be set forth in more detail below, the fuel pump 10 is arranged at last partially within the cavity 28 with the fuel pump inlet 14 adjacent to the port 30 in the container wall so that fuel that enters the container 12 is communicated with the fuel pump inlet.

An adapter 34, as shown in FIGS. 1-5, may be received between the fuel pump 10 and the container 12 within the cavity 28. In at least some implementations, the adapter 34 has a fuel pump receiving portion that defines a cavity and in assembly is arranged adjacent to and surrounding the inlet end cap 22 or bottom of the fuel pump 10. The adapter 34 may be sandwiched between the pump 10 and container 12, within the cavity 28, with an interference or press-fit to inhibit relative movement between the pump, the adapter and the container.

The adapter 34 may have a base 38 and two or more tabs 40 extending from the base to free ends 42 spaced from the base. The tabs 40 may be separated by intervening voids 44 so that the free ends 42 of the tabs are independent of each other and the tabs may flex independently relative to the base 38. With a fuel pump 10 having a cylindrical casing 20, the base 38 may be generally circular and the tabs 40 may extend generally axially from the base 38 and may flex inwardly toward an axis 46 (FIG. 1) of the base and fuel pump 10 or outwardly away from the axis 46. The tabs 40 have an inner surface 48 (FIGS. 3 and 5) at least part of which is adapted to be received laterally or radially against an outer surface of the casing 20. An outer surface 50 of the tabs 40 collectively define a diameter that is equal to or slightly greater than the diameter or perimeter length of the cavity 28 in the container 12 so that the outer surface 50 of the tabs 40 engage the sidewalls 26 defining the cavity 28 when the adapter 34 is received within the cavity. The tabs 40 may be flexible so that they may move inwardly and outwardly relative to the axis 46 from an unflexed or at rest position in which the tabs are without any force acting on the tabs tending to flex them. The tabs 40 may also be resilient such that they tend to yieldably resist such inward or outward movement, and tend to move back to or toward their unflexed or at rest when a force acting on them is sufficiently reduced or removed.

The outer diameter defined by the outer surface 50 of the tabs 40 may be greater than the outer diameter of the base 38, wherein a portion of the tabs 40 extend radially outwardly relative to the base 38 along the axial length of the tabs. In at least some implementations, the tabs 40 are not parallel to the outer surface of the casing 20 when installed on the fuel pump 10. In the implementation shown in FIGS. 1-5, the tabs have a first portion 52 (labeled in FIG. 2) connected at a first end 54 to the base 38 and that extends axially and radially outwardly from the base to a second end 56, and the tabs have a second portion 58 that extends axially away from the first portion 52 (to the free end 42 of the tab) and radially inwardly relative to the second end 56 of the first portion 52.

A limited area of contact (best shown in FIG. 5) is defined between each tab 40 and the fuel pump casing 20. In this example, the limited area of contact is adjacent to the free end 42 of each tab 40. With the radially inclined second portion 58 of the tabs 40, each tab may be arranged so that only a relatively small contact portion of the tab, including or adjacent to the free end 42, engages the casing 20. The axial extent of the engagement between each tab 40 and the casing 20 may be between 2 mm and 25 mm. Each tab 40 may have a circumferential width of between 2% and 48% of the circumference of the pump casing 20 such that the entirety of the circumference of the pump casing 20 is not engaged by the tabs 40 and a portion of the casing is exposed via the voids 44 between the tabs. In at least some implementations, a plurality of tabs 40 are provided and the circumferential extent of the contact portion of each tab 40 with the casing 20 is between 2% and 48% of the casing's circumference. In at least some implementations, less than 80% of the circumference of the pump casing 20 is engaged by the tabs 40, and in some implementations, less than 50% and between 25% and 50% of the casing's circumference is engaged by the tabs. Further, a total surface area of contact of all tabs 40 with the casing 20 may be between about 40 $mm^2$ and 400 $mm^2$.

Still further, in at least some implementations, flow areas are defined between the tabs 40 and the fuel pump casing 20 surrounding the contact portion of each tab 40 (e.g. above and below and around left and right sides of the contact areas in the orientation of the adapter 34 shown in the drawings). Accordingly, fluids are not likely to be trapped against the pump 10 about any significant surface area which, for example, may reduce the likelihood of corrosion of the pump casing 20 (e.g. due to water or other contaminants or corrosive things in the fuel of fuel system).

The base 38 may include an inlet opening 60 that is communicated with the container port 30 and with the fuel pump inlet 14 so that fuel that flows through the container port can flow to the fuel pump inlet and thereafter be pumped by the pump 10. The inlet opening 60 may include or be defined by an annular, axially extending projection 62 adapted to be received adjacent to or partially within the fuel pump inlet 14 (e.g. formed in the inlet body 22 of the fuel pump housing 16). In at least some implementations, the projection 62 may provide a seal with the fuel pump 10 to improve fuel flow to the fuel pump inlet 14. The container 12 may include a reservoir in which fuel is contained, and the port 30 in the container 12 may communicate the cavity 28 with the reservoir rather than the fuel tank so that fuel within the reservoir is communicated with the fuel pump 10. A separate inlet may be provided in the container through which fuel from a fuel supply (e.g. tank) is provided into the reservoir. Of course, these are just representative arrangements for the container 12 and fuel pump 10 and other arrangements may be used as desired.

To filter fuel before the fuel enters the fuel pump 10, the adapter 34 may include or carry a filter or screen 64. In at least some implementations, the screen 64 is carried by the adapter 34 and covers the inlet opening 60. In the embodiment shown, the screen 64 is coupled to the base 38 and is received between the base and the container wall 27 that is adjacent to the base. The screen 64 may include a periphery that is pressed into a groove in the adapter 34, or radially overlapped by one or more fingers, catches or latches of the adapter. Or the base 38 may include a knob 66 and the screen 64 may include an opening 68 (FIG. 4) designed to receive the knob 66 in a press-fit or interference fit to retain the screen 64 on the adapter 34. The screen 64 may thus be received between the port 30 in the container 12 and the inlet 60 in the adapter 34 so that fuel must flow through the screen 64 before entering the fuel pump inlet 14. The adapter 34 may also include feet 70 or standoffs. The feet 70 may engage the container wall 27 in the fully assembled position of the adapter 34 relative to the container 12 (i.e. when the adapter is fully inserted into the cavity 28), and the feet 70 may be circumferentially spaced apart to provide fluid flow gaps between the feet, and between the adapter 34 and the container 12.

The engagement of the flexible tabs 40 with the wall(s) 26 defining the cavity 28 may orient and/or retain the fuel pump 10 within the cavity 28, may reduce vibrations between the fuel pump 10 and container 28, and may do so even if the size of the cavity 28 varies within the range of flexibility of the tabs 40, such as may occur due to tolerances within a production run of containers 12 and a production run of fuel pumps 10 (e.g. fuel pump casings). The adapter 34 may be formed from a relatively soft material to damp vibrations, and from a material that is sufficiently flexible and resilient for the yieldable engagement with the container 12, and suitable for use in the fuels with which the container may be used. Representative but not limiting examples of materials from which the adapter 34 may be made include: various grades of Acetal (POM) or Nylon (PA). Materials may include mineral or fiber reinforcement to modify the stiffness or flexibility of the material to accommodate different vibration loading conditions which may be encountered in different applications.

Further, the limited surface area of contact between the adapter 34 and the fuel pump 10 reduce the areas wherein water or other contaminants may collect against the fuel pump housing 16 and corrode or otherwise foul the fuel pump 10, such as sometimes may occur when water is allowed to enter the fuel system and is in close contact between a rubber grommet or seal that is directly against and in contact with the fuel pump casing 20, which is often formed of a metal such as aluminum or steel. Here, the tabs 40 engage the pump casing 20 over a limited surface area, and in at least some implementations are not formed from a rubber or elastomer, and flow areas are defined around the contact portions of the tabs 40 so that no or less fluid is trapped against the pump casing 20.

If desired, a seal or grommet may still be used about the exterior of the adapter 34 between the adapter and the container 12. In at least some implementations, the seal or grommet does not directly engage the fuel pump 10. The seal may be carried by the container or adapter and surround the base axially spaced from the tabs 40 and voids 44 between the tabs, to engage the adapter 34 and the container wall(s) 26 and provide additional vibration damping between the adapter and container.

An example of an elastomeric ring 80 received around an adapter 82 and extending outwardly from a perimeter of the base 84 to engage the container 12 in assembly is shown in FIGS. 6-9, which show an alternate adapter. The base 84 may be similar to or the same as the base 38 of the adapter 34 already described. Four tabs 86 extend generally axially from the base 84 to free ends 88, and voids 90 exist between the tabs 86 so that the tabs are cantilevered to the base 84. The tabs 86 in this example do not extend radially outwardly and do not engage the container 12 in assembly. Instead, the tabs 86 engage only the fuel pump casing 20 and are flexible and resilient to accommodate variations in the outer diameter of the fuel pump casing. To provide a limited surface area of contact with the fuel pump casing 20, each tab 86 may have a radially inwardly extending protrusion 92 adapted to engage the pump (e.g. the pump casing 20). In at least some implementations, each protrusion 92 extends only a portion of the axial length (e.g. between 2% and 20%) and the circumferential width (e.g. between 2% and 50%) of the tab 86 on which the protrusion 92 is carried. In the implementation shown, the protrusions 92 are spaced from the base 84, are at the free end 88 or closer to the free end than to the base, and a flow area surrounds the protrusion 92 (on all sides or portions except that contacting the pump casing 20 and that attached to the tab 86). The flexible and resilient tabs 86 may damp vibrations from the fuel pump 10, and because they do not engage the container 12, may isolate much of the fuel pump from the container.

In the implementation shown, the bottom of the fuel pump 10 engages the base 84 and the base 84 engages the container 12, but the sidewall of the pump casing 20 engages the tabs 86 which do not directly engage the container walls 26 such that the sidewall of the pump casing 20 is isolated or separated from the container 12 by a fluid gap between the adapter tabs 86 and the container wall(s) 26. To further reduce fluid from being trapped between the adapter 82 and the casing 20 and/or to reduce the amount of material used to form the adapter 82, the tabs 86 may include one or more openings 94 therethrough, for example, in portions of the tabs 86 that do not engage the pump casing 20.

In this example, the periphery of the adapter base 84 does not engage the container 12. To isolate the adapter 82 from the container 12 and damp vibrations between them, the flexible ring 80 may be received around part of the adapter 82 as noted above, for example, the periphery of the base 84. The ring 80 extends radially outwardly from the periphery of the base 84 and is compressed between the adapter 82 and container 12 in assembly. This may also provide a seal between the adapter 82 and container 12 that prevents contaminants from bypassing the screen 64, ensuring that all fluid that enters the pump 10 has passed through the screen 64. The ring 80 may engage the bottom wall 27 of the cavity 28, or feet 96 may extend axially beyond the ring 80 and engage the wall 27. The adapter 82 defines a fuel pump receiving area between the inner surface 98 of the base 84 and the inner surface 99 of the tabs 86, and in at least some implementations, the ring 80 is separate from the fuel pump receiving area so that the ring 80 does not directly engage the fuel pump 10 received in the adapter 82. The ring 80 may be formed from any suitable material, including flexible and resilient materials like elastomers suitable for use in fuels with which the adapter 82 may be used, such as but not limited to, nitrile (NBR) or fluorocarbon (FKM) rubber. The adapter 82 may be otherwise similar to the adapter 34, and the same reference numerals applied to the adapter in FIGS. 6-9 denote components that are the same as or similar to components in the adapter 34.

FIGS. 10-13 illustrate an adapter 100 that is similar to the adapter 82 discussed above. To facilitate description of this adapter 100, the same reference numbers will be used to denote features and components in FIGS. 10-13 that are the same or similar as corresponding features or components in FIGS. 6-9. Adapter 100 has several tabs 86 coupled at their first end to the base 84 and extending axially to a free end 88. Voids 90 are provided between the tabs 86 so that they may flex independently and to provide flow areas between adjacent tabs 86. The inner surface 99 of the tabs 86 may include inwardly extending protrusions, in the form of circumferentially thin ribs 102 that extend radially inwardly to engage the pump 10 and separate the remainder of the inner surface 99 of the tabs 86 from the pump casing 20. The axial length of each rib 102 may be between 10% and 100% of the axial length of the tabs 86 and the circumferential width of each rib 102 may be between 2% and 20% of each tab. In the implementations shown, flow areas are provided about three sides of the ribs 102 (upper/axially spaced from the base inner surface, and circumferentially facing sides), although the ribs 102 could be spaced from the base 84 to provide an additional flow area if desired. One or more ribs 102 may be provided connected to each tab 86, as desired, and as shown, two ribs 102 are provided circumferentially spaced apart on each tab 86. The outer surface 104 of the tabs 86 may be separate from the wall(s) 26 that define the pump cavity 28 in the container 12 to isolate the tabs 86 and the fuel pump casing 20 from the container 12. Alternatively, as in the other embodiments, one or more of the tabs 86 could engage the container 12 if desired, for example, to better locate and retain the position of the pump 10 within the container 12.

A ring 80 may extend outwardly from the adapter 100 to be compressed between the adapter and container 12 in assembly. The ring 80 may be constructed and arranged as set forth with regard to adapter 82. Likewise, a filter or screen 64 may be carried by the adapter 100 to remove at least some contaminants from the fuel before the fuel is taken in by the fuel pump 10.

Thus, the adapters 34, 82, 100 provide an interface between the fuel pump 10 and the container 12 in which the fuel pump is received. In at least some implementations, to flexibly receive fuel pumps 10 having casings 20 of different dimensions, the adapter 34, 82, 100 may include multiple flexible tabs 40, 86 adapted to engage the fuel pump casing 20. At least two tabs 40, 86 may include a contact portion (e.g. end portion, protrusion, rib, etc.) that extends radially inwardly relative to another portion of the tab inner surface and the contact portions define a minimum opening dimension between the inner surface of the tabs 40, 86, where the minimum opening dimension is less than the dimension of the corresponding portion of the fuel pump casing 20 so that at least the tabs 40, 86 with the contact portions are flexed outwardly when the pump 10 is received within the adapter 34, 82, 100. The contact portions may have an inner surface facing the fuel pump receiving area and arranged to engage the fuel pump casing 20 over a limited contact area that is less than the area of the inside surfaces of the tabs, and flow areas may be provided around multiple sides or portions of the contact area to reduce fluids being trapped between the adapter 34, 82, 100 and pump casing 20. In at least some implementations, the contact area between the adapter and the pump casing is between 40 $mm^2$ and 400 $mm^2$, and the contact area spans less than 90% of the circumference of the pump casing.

In at least some implementations, to positively retain the position of the fuel pump 10 and adapter 34, 82, 100 relative to the container 12, the adapter may include a portion of a size equal to or slightly greater than the corresponding cavity 28 of the container 12 to provide a close fit or interference fit between them. In assembly, one or more flexible features, such as a tab 40 or ring 80, may engage the container 12 to damp vibrations between the pump 10 and container 12. To filter fuel before it enters the fuel pump, a screen 64 or adapter may be located upstream of the fuel pump inlet 14, may be carried by the adapter 34, 82, 100 and may be provided within a sealed chamber located between the adapter and container 12. The filter or screen 64 may be carried by the adapter 34, 82, 100, such as by a press-fit or interference fit of a portion of the screen with a portion of the adapter.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. An adapter for a fuel pump having a casing, the adapter comprising:

a base having an axis and an opening through which fluid may flow; and multiple tabs connected to the base, the tabs being circumferentially spaced apart with a void between at least part of the tabs, at least two tabs having a contact portion that extends radially inwardly to define a minimum diameter opening between the tabs, each contact portion extending along a portion less than all of the surface areas of the radially inner surface of the tabs wherein each of the at least two tabs has a first portion connected to the base and a second portion that extends from the first portion to an end of the tab, the at least two tabs having a portion that extends radially outwardly to define a maximum outer dimension of the adapter and a portion that extends radially inwardly to the contact portions.

2. The adapter of claim 1 wherein the tabs include a radially outer surface at least a portion of which defines a maximum radial dimension of the adapter when the tabs are in an unflexed or at rest position.

3. The adapter of claim 1 wherein the contact portions extend between 5% and 90% of the circumference of a circle bounded by the contact portions.

4. The adapter of claim 1 wherein each contact portion has an inner surface arranged to engage a fuel pump received between the tabs and the inner surface of all tabs have a combined surface area of less than 400 $mm^2$.

5. The adapter of claim 1 which also comprises a flexible ring carried by the adapter and extending radially outwardly from at least a portion of the adapter.

6. The adapter of claim 5 wherein the adapter defines a fuel pump receiving area between an inner surface of the base and the inner surface of the tabs, and the ring is separate from the fuel pump receiving area.

7. The adapter of claim 1 wherein the at least two tabs are flexible and resilient and may be radially inwardly flexed.

8. A fuel pump assembly, comprising:

a fuel pump having a casing with an inlet through which fuel enters the casing, and a pumping element received within the casing; and an adapter received around at least part of the casing and having a base that is received adjacent to the inlet, and wherein the adapter has an axis, an opening in communication with the inlet, and multiple tabs connected to the base, the tabs are circumferentially spaced apart with a void between at least part of two adjacent ones of the tabs, and wherein at least two tabs have an inner surface with a contact portion engaged with the casing and a portion of the inner surface is spaced radially outwardly from the casing, and wherein, when the tabs having the contact portions are in an unflexed position, the contact portions extend radially inwardly relative to an adjacent portion of the inner surface between the contact portions and the base.

9. The assembly of claim 8 wherein the contact portions extend between 5% and 90% of the circumference of a circle bounded by the contact portions.

10. The assembly of claim 8 wherein each contact portion has an inner surface arranged to engage a fuel pump received between the tabs and the inner surface has a surface area of less than 400 $mm^2$.

11. The assembly of claim 8 wherein each of the at least two tabs has a first portion connected to the base and a second portion that extends from the first portion to an end of the tab, the at least two tabs having a portion that extends radially outwardly to define a maximum outer dimension of the adapter and a portion that extends radially inwardly to the contact portions.

12. The assembly of claim 11 wherein the at least two tabs are flexible and resilient and may be radially inwardly flexed.

13. The assembly of claim 11 which also includes a container having a cavity in which the fuel pump and the adapter are at least partially received, the cavity having an inner dimension that is less than the maximum outer dimension of the adapter, and wherein at least some of the tabs are flexed inwardly when the adapter is received in the cavity.

14. The assembly of claim 8 which also includes a container having a cavity in which the fuel pump is at least partially received, the cavity defined at least in part by an inner surface of the container, and wherein an outer surface of at least two tabs engages the container inner surface.

15. A fuel pump assembly, comprising:

a fuel pump having a casing with an inlet through which fuel enters the casing, and a pumping element received within the casing;

an adapter received around at least part of the casing and having a base that is received adjacent to the inlet, and wherein the adapter has an axis, an opening in communication with the inlet, and multiple tabs connected to the base, the tabs are circumferentially spaced apart with a void between at least part of two adjacent ones of the tabs, and wherein at least two tabs have an inner surface with a contact portion engaged with the casing and a portion that is spaced radially outwardly from the casing; and a container having a cavity in which the fuel pump is at least partially received, the cavity defined at least in part by an inner surface of the container, and wherein an outer surface of at least two tabs engages the container inner surface, wherein the area of engagement between the outer surface of the tabs and the container inner surface is axially spaced from the contact portions of the tabs.

16. The assembly of claim 14 wherein the at least two tabs extend axially from the base and each of the at least two tabs engages the container along less than all of the axial length of the outer surface, and each of the at least two tabs engage the casing along less than all of the axial length of the inner surface.

17. The assembly of claim 8 which also includes a container having a cavity in which the fuel pump is at least partially received, the cavity defined at least in part by an inner surface of the container, and which also includes a flexible ring carried by the adapter and extending radially outwardly from at least a portion of the adapter and engaged with the container inner surface.

18. The assembly of claim 17 wherein at least some of the tabs do not engage the container inner surface.

19. The assembly of claim 18 wherein the contact portions are defined by protrusions that extend inwardly from the tabs having the contact portions.

* * * * *